US005878663A

United States Patent [19]

Krzyzak et al.

[11] Patent Number: 5,878,663

[45] Date of Patent: Mar. 9, 1999

[54] DAMPENER RECIRCULATOR APPARATUS FOR A PRINTING PRESS

[75] Inventors: Mike Krzyzak, Wappingers Falls, N.Y.; Patrick Maiello, Towaco, N.J.

[73] Assignee: Varn Products Company, Inc., Oakland, N.J.

[21] Appl. No.: 17,794

[22] Filed: Feb. 3, 1998

[51] Int. Cl.[6] ..... B41F 7/32

[52] U.S. Cl. ..... 101/148

[58] Field of Search ..... 101/147, 148, 101/207–210, 350.1, 363, 364; 137/87.02, 88, 91, 119.03, 119.08, 386, 391, 393, 395, 453, 454

[56] References Cited

U.S. PATENT DOCUMENTS 3,352,317 11/1967 Dahlgren ..... 101/148
3,485,257 12/1969 Gegenheimer et al. ..... 137/91
3,557,817 1/1971 Royse ..... 101/148 X
4,300,450 11/1981 Gasparrini ..... 101/364
4,608,158 8/1986 Ghisalberti et al. .

*Primary Examiner*—J. Reed Fisher
*Attorney, Agent, or Firm*—Cummings & Lockwood

[57] ABSTRACT

The subject invention is directed to a dampening system including a two-roller continuous type dampener, a solution recirculator, and a recirculator adapter. The solution recirculator is configured to supply solution through a supply conduit and to receive solution through a return conduit. A pressure regulator receives solution from the supply conduit and regulates the solution flow. A feed conduit provides fluid communication between the pressure regulator and the dampener's solution reservoir. A venturi receives solution from the supply conduit and induces a vacuum in a suction conduit. A first end of the suction conduit is positioned at a predetermined level within the reservoir and has a portion proximate the first end extending upwardly and away from the reservoir. A second end of the suction conduit is in fluid communication with the venturi. The venturi is in fluid communication with the return conduit.

32 Claims, 3 Drawing Sheets

DAMPENER RECIRCULATOR APPARATUS FOR A PRINTING PRESS

BACKGROUND OF THE INVENTION

1. Field of the Invention

The present invention relates generally to a dampening system for an offset lithographic printing press, and more particularly, to a dampener including a solution recirculator for maintaining fountain solution in the dampener reservoir.

2. Background of the Related Art

A variety of dampeners have been developed for the application of dampening solution in offset lithographic printing. To date, three distinct types of dampeners have emerged. The oldest type is the conventional, or ductor type dampener. The slip-roller continuous type dampener followed, and thereafter, the two-roller continuous type dampener was developed. Most dampeners on the market today are variations of one of these three types.

The conventional type dampener has a pan roller, rotating at a speed less than press speed, picking up the dampening solution from a pan style solution reservoir. The dampening solution is transferred from the pan roller to a set of dampening rollers, the dampening rollers rotating at a speed equal to press speed, by a ductor roller that alternately contacts the pan roller and one of the dampening rollers. A printing plate, on which the image to be printed is etched, is attached to a plate cylinder. After the solution is transferred to the dampening rollers, the rollers smooth out the solution to a somewhat consistent thickness and thereafter deposit it onto the non-image areas of the printing plate. The plate cylinder then rotates the plate past the press's inking form rollers which ink the image areas of the plate.

The slip-roller continuous type dampener also has a pan roller that rotates at a speed less than press speed and picks up the dampening solution from a pan style solution reservoir. Like the conventional system, the slip-roller continuous type dampener includes a set of dampening rollers, rotating at a speed equal to press speed, for smoothing out the dampening solution prior to the solution being applied to the printing plate. However, instead of the solution being transferred periodically by a ductor roller, the solution is transferred by a metering roller which is in constant slipping-contact relationship with the pan roller and one of the dampening rollers.

Both the conventional and slip-roller continuous type dampeners require the inclusion of 5% to 15% alcohol in the dampening solution. The alcohol reduces the surface tension of the solution, thereby enabling these type of dampeners to effectively wet the plate.

An example of a two-roller continuous type dampener is disclosed in U.S. Pat. No. 4,455,938 to Loudon, the disclosure of which is incorporated by reference in its entirety. It includes a form roller having an ink receptive compressible surface pressed against the plate which is attached to the plate cylinder. A metering roller presses against the form roller on a side of the form roller opposite the plate cylinder, forming a line of contact therebetween. The rollers rotate at a speed equal to that which the press operates in a direction which results in the formation of an inward nip—defined as a zone near the line of contact between two rotating rollers toward which the roller surfaces approach. Seals are pressed against the ends of the form roller and metering roller. The 'trough' created by the rollers and seals form a solution reservoir in which dampening solution is stored. Solution is metered between the rollers and transferred to the plate cylinder by the form roller as required by the printing plate. The two-roller continuous type dampener has proven to be a substantial improvement over the conventional and slip-roller continuous type dampeners in that it is a simpler design, easier to maintain and repair, requires only infrequent adjustments, and does not require alcohol for properly wetting the plate.

In any dampener, dampening solution must be periodically replenished in the solution reservoir as it is consumed during the printing operation. The most basic method of replenishing dampening solution is by inverting a container of solution over the solution reservoir and positioning the container opening at a level which the solution is to be maintained. Disadvantages associated with this method include adverse chemistry changes in the solution reservoir caused by impurities, such as ink and paper dust, that migrate from the plate cylinder. Also, since the solution remains essentially stagnant in the reservoir, pH "hotspots" develop at remote locations in the reservoir. Furthermore, because the container must be positioned above and relatively nearby the reservoir, compromises must be made when choosing the size and location of the dampening solution container. Finally, such an arrangement makes it difficult to maintain and control the alcohol content of the dampening solution in those systems requiring the use of alcohol.

The advent of solution recirculators has greatly improved conventional and slip-roller continuous type dampeners by eliminating many of the problems associated with inverted container type feeders. Solution recirculators typically include a housing in which a large solution storage tank is enclosed. A pump is attached to the tank for pumping solution through a supply conduit to the pan style solution reservoir. A rigid tube extends through the bottom of the pan facilitating removal of excess solution from the pan. The level of the solution in the reservoir is maintained by an adjustable collar that mates with the rigid tube on the interior of the pan. A return conduit provides fluid communication between the portion of the rigid tube extending from the bottom of the pan and the solution recirculator. The recirculator may include a chiller for lowering the temperature of the solution in the storage tank to reduce the evaporation rate of alcohol that may be included in the solution. Cooling the dampening solution has also been found advantageous for systems not requiring alcohol. Examples of solution recirculators are disclosed in U.S. Pat. No. 3,557,817 to Royse and U.S. Pat. No. 4,300,450 to Gasparrini.

One drawback inherent with prior art solution recirculating systems is that they are not adaptable to two-roller continuous type dampeners. This is primarily due to the fact that existing solution recirculators provide solution at relatively high and varying flow rates. In addition, excess solution in the reservoir is caused to return to the recirculator tank by employing gravity. In a dampener utilizing, for example, a pan type reservoir, these characteristics do not cause a problem. However, in a two-roller dampener these characteristics make solution recirculators unsuitable.

It is clear that there is a need in the art for a dampening system that includes a two-roller continuous type dampener that takes advantage of solution recirculators.

SUMMARY OF THE INVENTION

The subject invention is directed to a dampening system for an offset lithographic printing press. The dampening system includes a dampener having a form roller rotationally supported by sideframes. A metering roller is in parallel contiguous relation with the form roller. A reservoir is defined between the form roller and metering roller wherein dampening solution is contained.

A solution recirculator is configured to supply solution to the dampener through a supply conduit and to receive unused solution through a return conduit. A pressure regulator having a solution inlet and a solution outlet is in fluid communication with the supply conduit through the solution inlet. A feed conduit provides fluid communication between the solution outlet and the reservoir. A venturi includes an inlet port, a suction port, and an exhaust port. A vacuum is induced at the suction port as solution passes from the inlet port to the outlet port. A suction conduit includes a first end and a second end. The first end is positioned at a predetermined level within the dampener reservoir and has a portion proximate the first end extending upwardly and away from the surface of the solution contained in the reservoir. The second end of the suction conduit is in fluid communication with the suction port of the venturi.

A feed bracket is attached to the dampener and has a portion extending over the reservoir. A solution feed fitting is attached to the feed bracket extension portion and is in fluid communication with the feed conduit. The feed fitting directs solution from the feed conduit to the reservoir. A suction fitting is also attached to the feed bracket extension portion and is in fluid communication with the suction conduit. The fitting extension extends a predetermined distance into the dampener reservoir. Also included is a mechanism for adjusting the vertical position of the feed bracket so to enable adjustment of the level of the solution in the reservoir.

A flow restricter having an orifice of predetermined diameter extending therethrough is in fluid communication with the feed conduit between the pressure regulator and the reservoir. The restricter causes the flow rate of the solution passing from the pressure regulator to the dampener to be reduced and the flow to be equalized.

The dampening system further includes a valve moveable between an open position and a closed position. The valve is in fluid communication with the feed conduit between the pressure regulator and the reservoir. Solution is allowed to flow between the pressure regulator and the dampener reservoir when the valve is in the open position and the flow is discontinued when the valve is in the closed position.

A check valve is in fluid communication with the suction conduit between the dampener reservoir and the suction inlet of the venturi. The check valve is configured so solution flows only toward the suction inlet.

These and other features of the present invention will become more apparent to those skilled in the art upon inspection of the following detailed description read in conjunction with the attached figures.

BRIEF DESCRIPTION OF THE DRAWINGS

So that those having ordinary skill in the art to which the subject invention appertains will more readily understand how to make and use the dampening system described herein, a preferred embodiment of the invention will be described in detail herein below with reference to the drawings wherein.

DETAILED DESCRIPTION OF THE PREFERRED EMBODIMENTS

Figure 1:
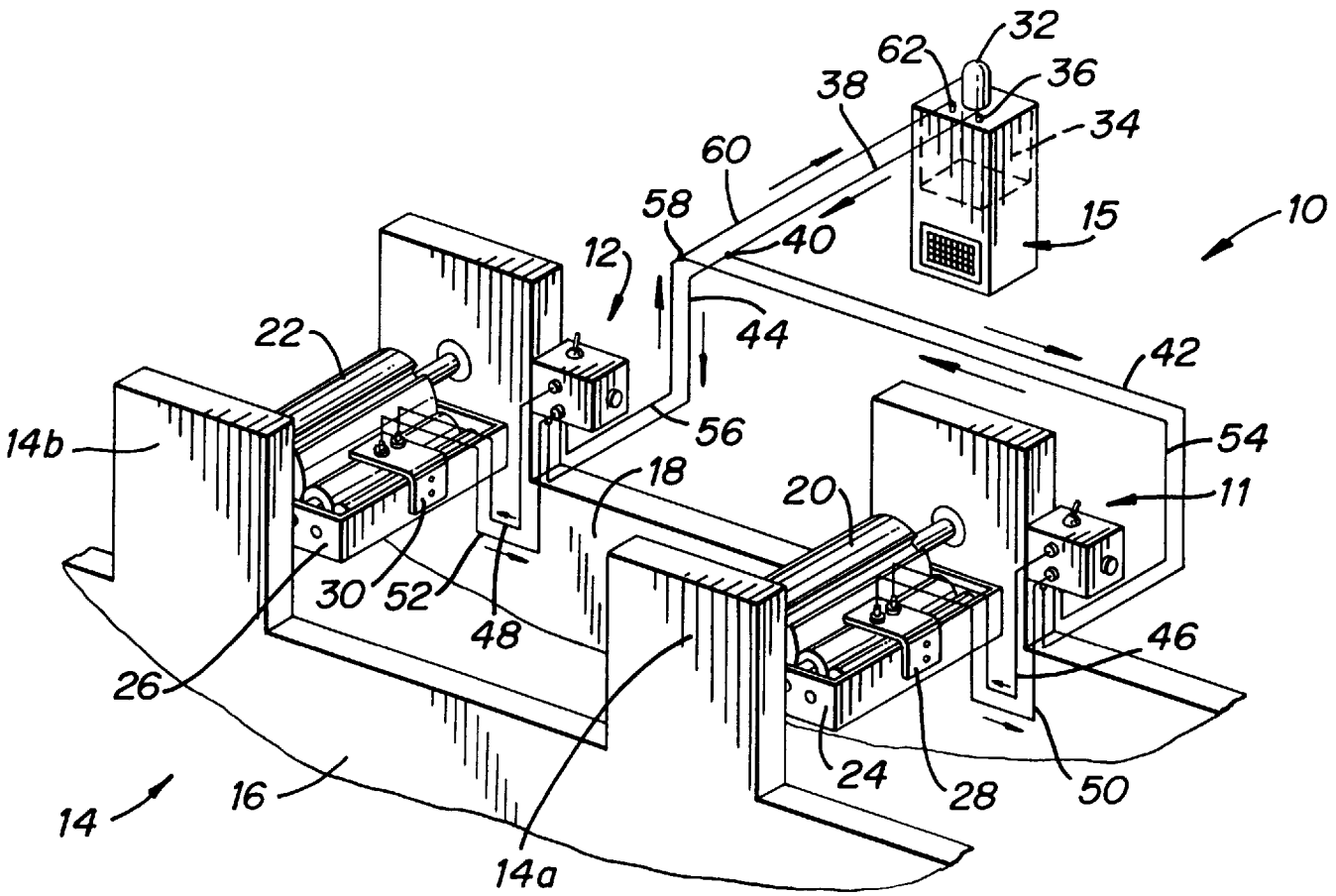
FIG. 1 is a perspective view of two heads of a printing press and includes a dampening system made in accordance with a preferred embodiment of the subject invention.

Referring now to the drawings wherein like reference numerals identify similar structural elements of the subject invention, there is illustrated in FIG. 1 a portion of a printing press 14 supporting a first color head 14*a* and a second color head 14*b*. Also illustrated is a dampening system for a printing press constructed in accordance with a preferred embodiment of subject invention and designated generally by reference number 10. Dampening system 10 basically includes first head dampener 24 and second head dampener 26, first head recirculator adapter 11 and second head recirculator adapter 12, and a solution recirculator 15. These components and the various conduits and fittings interconnecting them will be described in more detail below.

Printing press 14 is of the type used for offset lithographic printing and is shown greatly simplified to ease in illustrating the relationship between the press and the present invention. Those skilled in the art will readily recognize that various other components, e.g., blanket and impression cylinders, inking rollers, roller hangers, paper handling mechanisms, etc., are required for an accurate depiction of an offset lithographic a printing press.

With continuing reference to FIG. 1, printing press 14 includes a nearside frame 16 and a farside frame 18 between which are supported a first plate cylinder 20 and a second plate cylinder 22. Printing plates, aluminum or polyester sheets that are etched or otherwise processed to carry the image to be printed, are attached to the outer diameter of plate cylinders 20 and 22. During printing operations, dampening solution is applied to the printing plates of plate cylinders 20 and 22 by dampeners 24 and 26, respectively. Subsequently, ink is applied to each printing plate by respective sets of ink rollers (not shown).

Dampeners 24 and 26 are two-roller continuous type dampeners such as those described in U.S. Pat. No. 4,455,938 to Loudon the disclosure of which is incorporated by reference herein. The dampeners 24 and 26 are each associated with a mechanism (not shown) for facilitating their movement either towards or away from plate cylinders 20 and 22, respectively. This movement causes the dampener form roller to separate from its respective plate cylinder when the printing head associated therewith is not to be used. Conversely, the mechanism engages the dampener form roller with its corresponding plate cylinder when the associated printing head is to be used during the printing operation. On more modern presses, in particular those having multiple printing heads, each dampener can also be disabled from rotating so that when the press is rotating and the printing operation is initiated, the disabled dampener remains in the separated position and is disengaged from rotating.

With continuing reference to FIG. 1, first and second dampener feed brackets 28 and 30 are mounted to dampeners 24 and 26, respectively. Through a series of conduits, to be described in more detail below, dampening solution is supplied to fittings attached to the dampener feed brackets 28 and 30. Feed brackets 28 and 30 are vertically adjustable to enable the level of the dampening solution within the reservoirs of dampeners 24 and 26 to be varied.

The solution recirculator 15 includes a pump 32 and storage tank 34. Dampening solution is stored in the storage tank 34 and constantly pumped by pump 32 through a series of conduits to the recirculator adapters 11 and 12. Thereafter, the recirculator adapters 11 and 12 regulate at least a portion of the solution and supply the regulated solution to dampeners 24 and 26, respectively. Excess solution in the reservoirs is returned to the solution recirculator 15. A more detailed description of the above follows.

Solution is pumped by the solution recirculator pump 32 from the storage tank 34, through the pump output fitting 36, to a conduit 38. The flow of the solution is divided at a T-fitting 40 and pumped through conduits 42 and 44 to recirculator adapters 11 and 12, respectively. As will be described in more detail below, the flow rate of at least a portion of the solution is reduced as it passes through recirculator adapters 11 and 12, and is thereafter directed through conduits 46 and 48 to feed brackets 28 and 30 and into the respective dampener reservoirs. The remaining solution is utilized within recirculator adapters 11 and 12 to generate a suction head for drawing solution from the reservoir of dampeners 24 and 26.

Due to the suction head generated by recirculator adapters 11 and 12, excess solution is drawn from the reservoirs of dampeners 24 and 26 through conduits 50 and 52, respectively. The solution is then returned from recirculator adapters 11 and 12, through respective conduits 54 and 56, to a T-fitting 58. Thereafter, the solution flows through a conduit 60, and returns through return fitting 62 into the storage tank 34 of the solution recirculator 15.

It should be readily apparent to those skilled in the art that a single recirculator adapter can be used in conjunction with the solution recirculator 15. It should also be apparent that several recirculator adapters can be used in conjunction the recirculator 15, providing the solution recirculator pump 32 is sized to provide an adequate supply of solution to each recirculator adapter so that they function properly.

Figure 2:
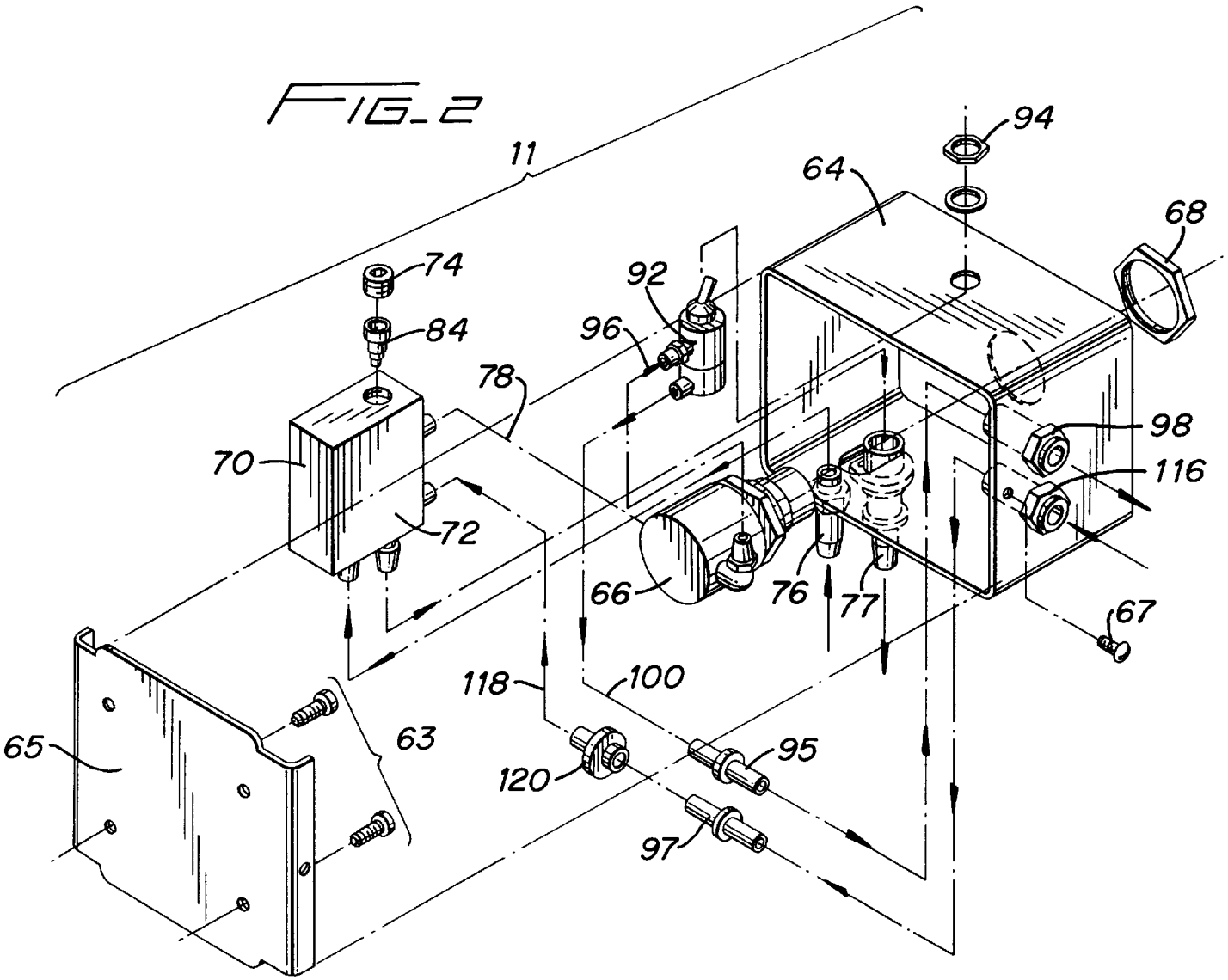
FIG. 2 is a perspective view of a recirculator adapter with the component parts thereof separated from one another to assist in better understanding the subject invention.
Figure 3:
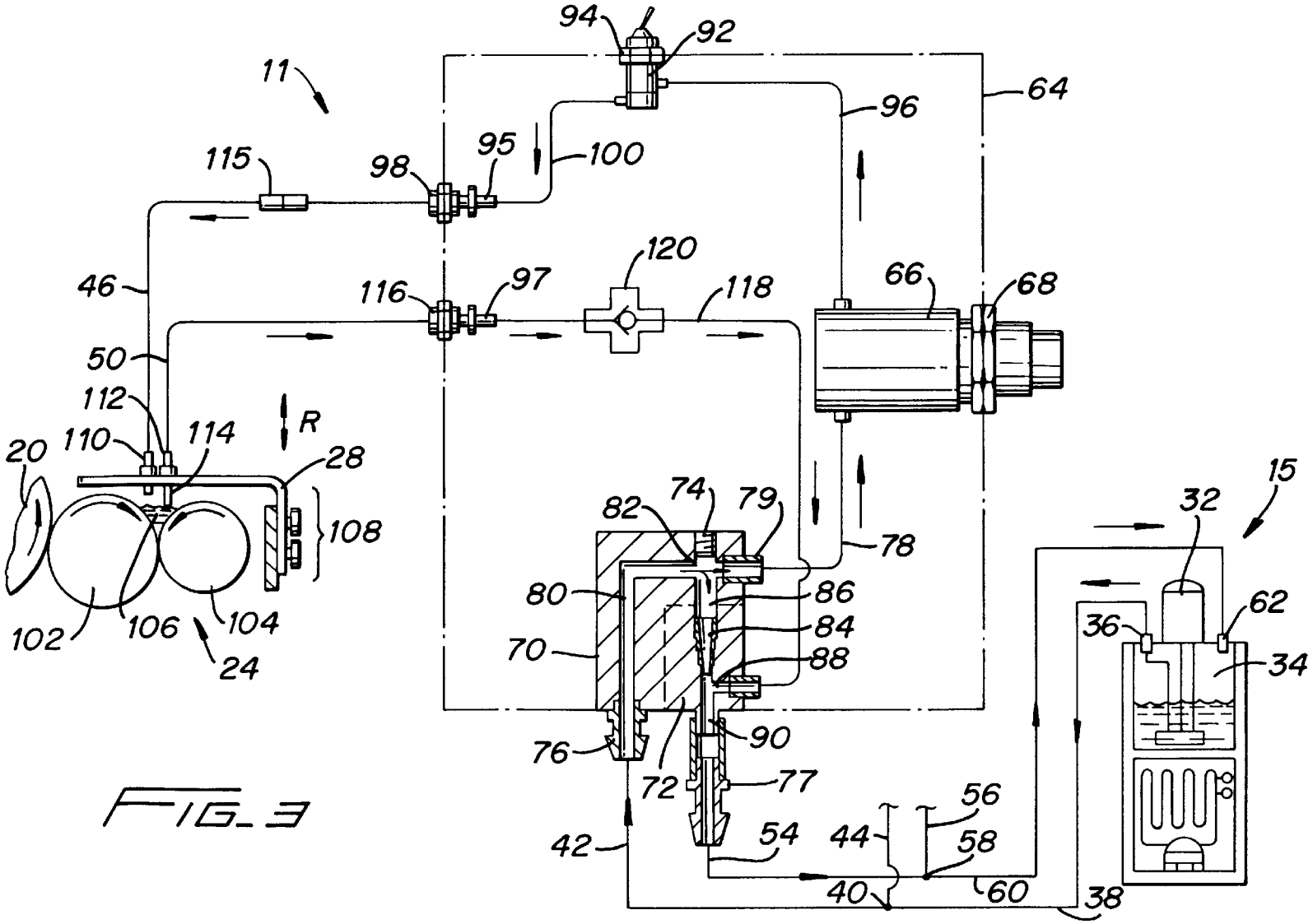
FIG. 3 is a diagram illustrating the dampening system and the relationship between the components, namely, the dampener, the recirculator adapter, and the solution recirculator.

Referring now to FIGS. 2 and 3, recirculator adapter 11 is illustrated with its component parts separated and in schematic form, respectively. It should be noted that recirculator adapter 12 includes the same components and operates in an manner identical to recirculator adapter 11. Therefore, the explanation below applies to it equally.

An enclosure 64 serves as the housing for the recirculator adapter 11 and includes various sized through-holes for attaching the component parts thereto. An attachment plate 65 is secured to the rear opening of the enclosure 64 with at least one fastener 67. The attachment plate 65 is attached to the farside frame 18 or a farside cover (not shown) using fasteners 63. A pressure regulator 66, adjustable between, for example, 0 p.s.i.g. and 5 p.s.i.g., extends through an endwall of the enclosure 64 and is secured in place with a panel nut 68. A manifold 70, having a venturi 72 made integral thereto, is secured to the base of the enclosure 64 with a straight tube fitting 76. A 0.5 inch to 0.38 inch reducer 77 is attached on the downstream side of venturi 72. A conduit 78 is attached to manifold 70 by a fitting 79 and provides fluid communication between manifold 70 and pressure regulator 66.

Manifold 70 includes a main conduit 80 extending from the straight fitting 76, past a T-section 82 formed within manifold 70, to fitting 79. Solution fed to the main conduit 80 of manifold 70 is divided at T-section 82 between conduit 78 and venturi 72.

The venturi 72 includes an inlet port 86, a suction port 88, and an exhaust port 90. A venturi nozzle 84 is positioned between the inlet port 86 and the suction and exhaust ports 88 and 90, respectively. In a preferred embodiment of the subject invention, and by way of example, the venturi nozzle 84 has an inlet diameter of 0.27 inch and an outlet diameter of 0.09 inch. Plug 74 is removable to allow for the insertion of the venturi nozzle 84 within the venturi 72. An alternate method of manufacture involves directly machining the shape of the venturi nozzle 84 into the body of the venturi 72. Although the venturi 72 is shown as an integral part of manifold 70, it may be made as a separate component.

A toggle valve 92 for controlling the flow of solution extends through an upper wall of the enclosure 64 and is secured in place with a panel nut 94. A conduit 96 provides fluid communication between the pressure regulator 66 and the toggle valve 92. A tube connector 98 having a tube adapter 95 attached thereto extends through a sidewall of enclosure 64 providing fluid communication between the interior and exterior of enclosure 64. Conduit 100 provides fluid communication between toggle valve 92 and tube adapter 95. Alternatively, a needle valve or other type of regulating valve may be used in place of toggle valve 92.

Referring now in particular to FIG. 3, dampener 24 includes a form roller 102 in contacting relationship with a metering roller 104. End seals (not shown) are lightly pressed against the ends of form roller 102 and metering roller 104 defining a solution reservoir 106 therebetween. Dampening solution is drawn from reservoir 106 by form roller 102 during the printing process for wetting the plate.

The dampener feed bracket 28 is attached to the rear portion of the dampener 24 and is vertically adjustable, as indicated by the directional arrow 'R', after loosening a pair of fasteners 108. A feed fitting 110 and suction fitting 112 are attached to and extend through the dampener feed bracket 28. A suction fitting extension 114 is attached to the lower portion of the suction fitting 112 and extends a predetermined distance into solution reservoir 106. By adjusting the position of the feed bracket 28, the level of the solution in the reservoir 106 can be raised or lowered. Suction fitting 112 and its extension 114 may alternatively be made to adjust independent of the dampener feed bracket 28.

Conduit 46 provides fluid communication between connector 98 and feed fitting 110. A restricter 115 is included in conduit 46 to reduce the flow rate and equalize the flow of the solution regulated by pressure regulator 66. In circumstances where flow is not critical, e.g., in large dampeners having large solution reservoirs, restricter 115 may be omitted without causing flow control problems.

A tube connector 116 having a tube adapter 97 attached thereto extends through the sidewall of enclosure 64 to provide fluid communication between the interior and exterior of enclosure 64. Conduit 50 provides fluid communication between suction fitting 112 and tube connector 116. A conduit 118 provides fluid communication between tube adapter 97 and suction port 88 of venturi 72. A check valve 120 is included in conduit 118 to prevent back-flow of solution into the solution reservoir 106 when pump 32 of the solution recirculator 15 is de-energized. Under certain circumstances, e.g., when the recirculator adapter 11 is attached to the press 14 in a position below the reservoir 106, or when the total length of conduits 50 and 118 is relatively short, check valve 120 may be omitted without concern that solution will overflow reservoir 106. As an alternative to check valve 120, an on/off valve (not shown), such as toggle valve 92, may be employed for controlling the flow of solution between the reservoir 106 and the venturi 72 when the adaptor is not in use.

In operation, a constant supply of dampening solution is provided by the solution recirculator 15 to main conduit 80 of manifold 70. The solution flow is proportioned at T-section 82, within manifold 70, between conduit 78 and the inlet port 86 of venturi 72. The portion of solution flow directed through venturi inlet port 86 passes venturi nozzle 84 and establishes a low pressure zone immediately downstream nozzle 84. This low pressure zone is realized at suction port 88. The portion of the solution flow directed through conduit 78 passes pressure regulator 66 and is reduced in pressure therein allowing for the controlled flow of solution to dampener 24.

To print, toggle valve 92 is switched to the 'on' position, thereby allowing solution to flow from the manifold 70 to the dampener 24. Alternatively, when the toggle valve 92 is switched to the 'off' position, solution is prevented from flowing. With the toggle valve 92 in the 'on' position, the rate of flow of solution into reservoir 106 is altered by adjusting pressure regulator 66 from a maximum flow rate, where the pressure regulator 66 is adjusted to, for example, 5 p.s.i.g., to zero flow rate, where the pressure regulator 66 is adjusted to zero p.s.i.g.

The solution level in reservoir 106 is allowed to rise to the bottom end of the suction fitting extension 114. When solution reaches the bottom of suction fitting extension 114 it is drawn through conduits 50 and 118 to suction port 88 of venturi 72. Thereafter, the solution is returned to the solution recirculator storage tank 34 by way of conduits 54 and 60.

It is envisioned that alternative methods for creating a vacuum can be incorporated in place of venturi 72. For example, a diaphragm pump motivated by air or electricity can be readily employed and would be in keeping with a preferred embodiment of the subject invention. In such a case, excess solution passing through T-section 82 would return directly to conduit 54. The diaphragm pump, of course, would not require an inlet port as does the venturi 72.

Although the invention is described herein above to maintain the level of dampening solution in a solution reservoir of a dampener of an offset lithographic printing press, it is envisioned that the recirculating system can be readily modified for use in various other applications wherein the flow of solution supplied by a solution recirculator is required to be circulated through a reservoir in like manner. In particular, where the flow rate of the solution emanating from the solution recirculator is required to be reduced prior to being supplied to the reservoir and, for advantages particular to the machine involved, the solution must be drawn upwardly and away from the surface of the solution in the reservoir.

Even though the preferred embodiment of the invention has been illustrated and described herein, it is intended to be understood by those skilled in the art that various changes or modifications can be made to the invention without departing from the spirit and scope of the invention as defined in the appended claims.

What is claimed is:

1. An apparatus for adapting a solution recirculator of the type having a supply conduit and a return conduit to a dampener of the type having a reservoir configured to contain solution, said apparatus comprising:

a pressure regulator having a solution inlet and a solution outlet, said solution inlet in fluid communication with the supply conduit;

a feed conduit providing fluid communication between said solution outlet and the reservoir;

means for vacuuming solution having a suction port at which vacuum is effectuated and an outlet port from which vacuumed solution is expelled, said outlet port being in fluid communication with the return conduit; and a suction conduit having a first end and a second end, said first end of said suction conduit positioned in such a manner so as to establish a predetermined solution level within the reservoir and having a portion proximate said first end extending upwardly and away from the reservoir, said second end of said suction conduit in fluid communication with said suction port, whereby a regulated quantity of solution is supplied to the reservoir and solution in the reservoir that rises above said predetermined level is drawn upwardly from the reservoir and returned to the solution recirculator.

2. An apparatus as recited in claim 1, further including a restricter in fluid communication with said feed conduit.

3. An apparatus as recited in claim 1, wherein said vacuum means is defined by a venturi having an inlet port in fluid communication with the supply conduit, said venturi inducing said vacuum in said suction port as solution passes from said inlet port to said outlet port.

4. An apparatus as recited in claim 3, further including a manifold having a main conduit extending therethrough, a first end of said main conduit in fluid communication with the supply conduit and a second end of said main conduit in fluid communication with said solution inlet.

5. An apparatus as recited in claim 4, further including a venturi conduit extending from said main conduit to said inlet port providing fluid communication therebetween.

6. An apparatus as recited in claim 5, wherein said venturi is formed integral with said manifold.

7. An apparatus as recited in claim 1, further including a bracket attached to the dampener and having said first end of said suction conduit operatively attached thereto.

8. An apparatus as recited in claim 7, further including means for vertically adjusting said bracket to alter the solution level in the reservoir.

9. An apparatus as recited in claim 7, further including a suction fitting in fluid communication with said first end of said suction conduit and attached to said bracket, said suction fitting having an extension depending therefrom that extends a predetermined distance into the reservoir.

10. An apparatus as recited in claim 1, further including a valve in fluid communication with said feed conduit, said valve adjustable between an open position, wherein solution is permitted to pass from said solution outlet to the reservoir, and a closed position, wherein solution is prevented from passing from said solution outlet to the reservoir.

11. An apparatus as recited in claim 1, further including a check valve in fluid communication with said suction conduit, said check valve configured to permit solution to flow only toward said suction port.

12. A recirculator apparatus for maintaining solution in the reservoir of a dampener comprising:

a tank configured to contain a volume of solution;

a pump operatively associated with said tank and having a pump outlet through which solution is expelled;

a supply conduit in fluid communication with said pump outlet;

a pressure regulator having a solution inlet and a solution outlet, said solution inlet in fluid communication with said supply conduit;

a feed conduit providing fluid communication between said solution outlet and the reservoir;

a venturi having an inlet port in fluid communication with said supply conduit, an outlet port in fluid communication with said tank, and a suction port at which a vacuum is developed as solution passes from said inlet port to said outlet port; and a suction conduit having a first end positioned at a predetermined level within the reservoir and having a portion proximate said first end extending upwardly and away from the reservoir, and a second end in fluid communication with said suction port, whereby a regulated quantity of solution is supplied to the reservoir, and solution in the reservoir rising above a predetermined level is drawn upwardly from the reservoir and returned to said tank.

13. A recirculator apparatus as recited in claim 12, further including a restricter in fluid communication with said feed conduit.

14. A recirculator apparatus as recited in claim 12, further including a manifold having a main conduit extending therethrough, a first end of said main conduit in fluid communication with said supply conduit and a second end of said main conduit in fluid communication with said solution inlet.

15. A recirculator apparatus as recited in claim 14, further including a venturi conduit extending from said main conduit to said venturi inlet port providing fluid communication therebetween.

16. A recirculator apparatus as recited in claim 15, wherein said venturi is formed integral with said manifold.

17. A recirculator apparatus as recited in claim 12, further including a bracket attached to the dampener, said bracket having said first end of said suction conduit operatively attached thereto.

18. A recirculator apparatus as recited in claim 17, further including means for vertically adjusting said bracket to alter the solution level in the reservoir.

19. A recirculator apparatus as recited in claim 17, further including a suction fitting in fluid communication with said first end of said suction conduit and attached to said bracket, said suction fitting having an extension depending therefrom that extends a predetermined distance into the reservoir.

20. A recirculator apparatus as recited in claim 12, further including a valve in fluid communication with said feed conduit, said valve adjustable between an open position, wherein solution is permitted to pass from said solution outlet to the reservoir, and a closed position, wherein solution is prevented from passing from said solution outlet to the reservoir.

21. A recirculator apparatus as recited in claim 12, further including a check valve in fluid communication with said suction conduit, said check valve oriented such that solution flows only toward said suction port.

22. A dampening system for an offset lithographic printing press, said dampening system comprising:

a) a dampener including:

i) a form roller rotationally supported by sideframes, and ii) a metering roller in parallel contiguous relation with said form roller, said form roller and said metering roller defining a reservoir therebetween wherein solution is contained;

b) a solution recirculator configured to supply solution through a supply conduit and to receive solution through a return conduit;

c) a pressure regulator having a solution inlet and a solution outlet, said solution inlet is in fluid communication with said supply conduit;

d) a feed conduit providing fluid communication between said solution outlet and said reservoir;

e) means for creating a vacuum including a suction port at which vacuum is effectuated and an outlet port from which vacuumed solution is expelled, said outlet port in fluid communication with said return conduit; and f) a suction conduit having a first end and a second end, said first end positioned at a predetermined level within said reservoir and having a portion proximate said first end extending upwardly and away from said reservoir, said second end in fluid communication with said suction port, whereby a regulated quantity of solution is supplied to said reservoir, and solution in said reservoir rising above said predetermined level is drawn upwardly and returned to said solution recirculator.

23. A dampening system as recited in claim 22, wherein said vacuum means is defined by a venturi and further includes an inlet port in fluid communication with said supply conduit, said venturi inducing said vacuum in said suction port as solution passes from said inlet port to said outlet port.

24. A dampening system as recited in claim 23, further including a manifold having a main conduit extending therethrough, a first end of said main conduit in fluid communication with said supply conduit and a second end of said main conduit in fluid communication with said solution inlet.

25. A dampening system as recited in claim 24, further including a venturi conduit extending from said main conduit to said inlet port providing fluid communication therebetween.

26. A dampening system as recited in claim 25, wherein said venturi is formed integral with said manifold.

27. A dampening system as recited in claim 22, further including a bracket attached to said dampener and having said first end of said suction conduit operatively attached thereto.

28. A dampening system as recited in claim 27, further including means for vertically adjusting said bracket to alter said solution level in said reservoir.

29. A dampening system as recited in claim 27, further including a suction fitting in fluid communication with said first end of said suction conduit and attached to said bracket, said suction fitting having an extension depending therefrom that extends a predetermined distance into said reservoir.

30. A dampening system as recited in claim 22, further including a restricter in fluid communication with said feed conduit.

31. A dampening system as recited in claim 22, further including a valve in fluid communication with said suction conduit, said valve adjustable between an open position, wherein solution is permitted to pass from said reservoir to said suction port, and a closed position, wherein solution is prevented to pass from said reservoir to said suction port.

32. A dampening system as recited in claim 22, further including a check valve in fluid communication with said suction conduit, said check valve configured to permit solution to flow only toward said suction port.

* * * * *